US010427057B2

(12) United States Patent
Keller et al.

(10) Patent No.: US 10,427,057 B2
(45) Date of Patent: Oct. 1, 2019

(54) MULTI-USER SWING SET

(71) Applicant: Landscape Structures Inc., Delano, MN (US)

(72) Inventors: Thomas L. Keller, Delano, MN (US); Bryant A. Jones, St. Louis Park, MN (US)

(73) Assignee: Landscape Structures Inc., Delano, MN (US)

( * ) Notice: Subject to any disclaimer, the term of this patent is extended or adjusted under 35 U.S.C. 154(b) by 0 days.

(21) Appl. No.: 15/851,819

(22) Filed: Dec. 22, 2017

(65) Prior Publication Data

US 2018/0221776 A1 Aug. 9, 2018

Related U.S. Application Data

(60) Provisional application No. 62/456,915, filed on Feb. 9, 2017, provisional application No. 62/483,649, filed on Apr. 10, 2017.

(51) Int. Cl.

| | |
|---|---|
| ***A63G 9/00*** | (2006.01) |
| ***A63G 9/02*** | (2006.01) |
| *A47D 9/02* | (2006.01) |

(52) U.S. Cl.

CPC ..... *A63G 9/02* (2013.01); *A63G 9/00* (2013.01)

(58) Field of Classification Search

CPC ... A63G 9/00; A63G 9/02; A63G 9/12; A63G 9/16; A47C 3/0255; A47C 11/005; A47D 9/02; A47D 13/105

USPC ..... 472/118–125; 297/77, 273, 274

See application file for complete search history.

(56) References Cited

U.S. PATENT DOCUMENTS

| | | | |
|---|---|---|---|
| 226,482 | A | 4/1880 | Bowen |
| 686,420 | A | 11/1901 | Powell |
| 2,423,950 | A | 7/1947 | Smith |
| 2,516,975 | A | 8/1950 | Gazella |
| 2,701,604 | A | 2/1955 | St Louis |
| 3,044,774 | A | 7/1962 | Hannas |
| 3,130,969 | A | 4/1964 | Groth |
| 3,145,024 | A | 8/1964 | Grudoski |
| 3,145,990 | A | 8/1964 | Prouty |

(Continued)

FOREIGN PATENT DOCUMENTS

| | | | |
|---|---|---|---|
| EP | 2067510 | A1 | 6/2009 |
| JP | 2000116958 | A | 4/2000 |

(Continued)

OTHER PUBLICATIONS

PCT International Seareh Report and Written Opinion dated Jun. 26, 2018. 11 pages.

(Continued)

*Primary Examiner* — Kien T Nguyen

(74) *Attorney, Agent, or Firm* — Wesley W. Malherek; Kelly, Holt & Christenson, PLLC

(57) ABSTRACT

A swing seat is presented. The swing seat comprises a first user seat with a first user frame and a first user seating area. The swing seat also comprises a second user seat with a second user frame and a second user seating area. The swing seat also comprises a connection mechanism configured to couple the first user frame to the second user frame. Each of the first and second user seats comprises a connection feature configured to connect to a swing frame.

9 Claims, 7 Drawing Sheets

(56) References Cited

U.S. PATENT DOCUMENTS

| | | | | |
|---|---|---|---|---|
| 3,447,802 | A | 6/1969 | Grudoski | |
| 3,615,119 | A | 10/1971 | Irwin | |
| 3,825,299 | A | 7/1974 | Gaucher | |
| 4,382,595 | A | 5/1983 | Tolar | |
| 4,570,928 | A | 2/1986 | Smith | |
| 4,620,702 | A | 11/1986 | Hernmeter | |
| 4,699,423 | A | 10/1987 | Fitzig et al. | |
| 1,315,775 | A | 3/1991 | Jones | |
| 5,067,706 | A | 11/1991 | Tsai | |
| 5,154,672 | A | 10/1992 | Brown | |
| 5,326,326 | A | 7/1994 | Cunard et al. | |
| 5,393,268 | A | 2/1995 | Cunard et al. | |
| 5,505,664 | A | 4/1996 | Nolan et al. | |
| 5,533,934 | A | 7/1996 | Miller | |
| 5,564,987 | A * | 10/1996 | Ayrolles | A47C 3/0255 297/281 |
| 5,766,084 | A | 6/1998 | Smith | |
| 5,839,965 | A | 11/1998 | Mullins | |
| D433,242 | S | 11/2000 | Langston | |
| 6,416,132 | B1 | 7/2002 | Norton et al. | |
| 6,482,096 | B1 | 11/2002 | Rieber et al. | |
| 6,547,328 | B2 | 4/2003 | Liu | |
| 6,994,631 | B1 | 2/2006 | Habing | |
| 7,175,535 | B1 | 2/2007 | Marmentini | |
| 7,300,355 | B1 | 11/2007 | Hense | |
| 7,578,746 | B1 * | 8/2009 | Johnson | A63G 9/00 297/485 |
| 8,147,345 | B2 * | 4/2012 | Furman | A47D 13/02 297/273 |
| 8,608,582 | B2 | 12/2013 | Ochi | |
| 8,992,337 | B1 | 3/2015 | Koziol et al. | |
| 9,084,940 | B2 | 7/2015 | Norquist et al. | |
| 9,533,323 | B2 | 1/2017 | Sauzade | |
| 2016/0250561 | A1 | 9/2016 | Norquist et al. | |

FOREIGN PATENT DOCUMENTS

| | | | |
|---|---|---|---|
| JP | 2002126357 | A | 5/2002 |
| JP | 2009100992 | A | 5/2009 |
| KR | 2020110008319 | U | 8/2011 |
| KR | 101537501 | B1 | 7/2015 |

OTHER PUBLICATIONS

"Sunset Swings-460G-4-Person Swing", retrieved at <http://www.sunsetswings.com/products/460G_swing/>, retrieved on Sep. 22, 2016, 3 pages.

* cited by examiner

100

MULTI-USER SWING SET

CROSS-REFERENCE TO RELATED APPLICATIONS

The present application is based on and claims the benefit of U.S. provisional patent application Ser. No. 62/456,915, filed Feb. 9, 2017 and U.S. provisional patent application Ser. No. 62/483,649, filed Apr. 10, 2017, the contents of which are hereby incorporated by reference in their entirety.

BACKGROUND

Swings are known structures in the playground industry. A typical swing includes a seat suspended from a frame, on which a user sits. The user can either propel themselves forward and backward to achieve a swinging motion, or receive a push from another user.

SUMMARY

A swing seat is presented. The swing seat comprises a first user seat with a first user frame and a first user seating area. The swing seat also comprises a second user seat with a second user frame and a second user seating area. The swing seat also comprises a connection mechanism configured to couple the first user frame to the second user frame. Each of the first and second user seats comprises a connection feature configured to connect to a swing frame.

DETAILED DESCRIPTION OF ILLUSTRATIVE EMBODIMENTS

There are many design considerations in building playground structures. The structure should be weather resistant and resilient to user wear. The device should also be usable while also resistant to vandalism and theft. The device should also require minimal maintenance, and be designed for use in an outdoor space with little or no adult supervision. Many playground structures are subject to industry standards and regulations regarding safe usage.

A fixture in any playground design is the swing—a seat suspended from the ground configured to allow a user to move back and forth along an arc, either using their own momentum, or propelled by a pushing force from a second user. Often, swings are designed with a range of user age and ability in mind—the same swing could be used by a child or their parent, for example. Swings can either be self-propelled, e.g. by a user initially kicking off from the ground and pumping their legs to gather momentum, or can be driven forward by a 'pushing' force by a second user. For families with more than one child unable to propel themselves, the swing set can provide a source of tension, as different children want a turn being pushed, and/or may need to be supervised doing another activity simultaneously. It is desired to provide a swing structure that can accommodate multiple users. In some embodiments, multiple seats within a single swing structure may be configured such that users face each other.

Figure 1A:
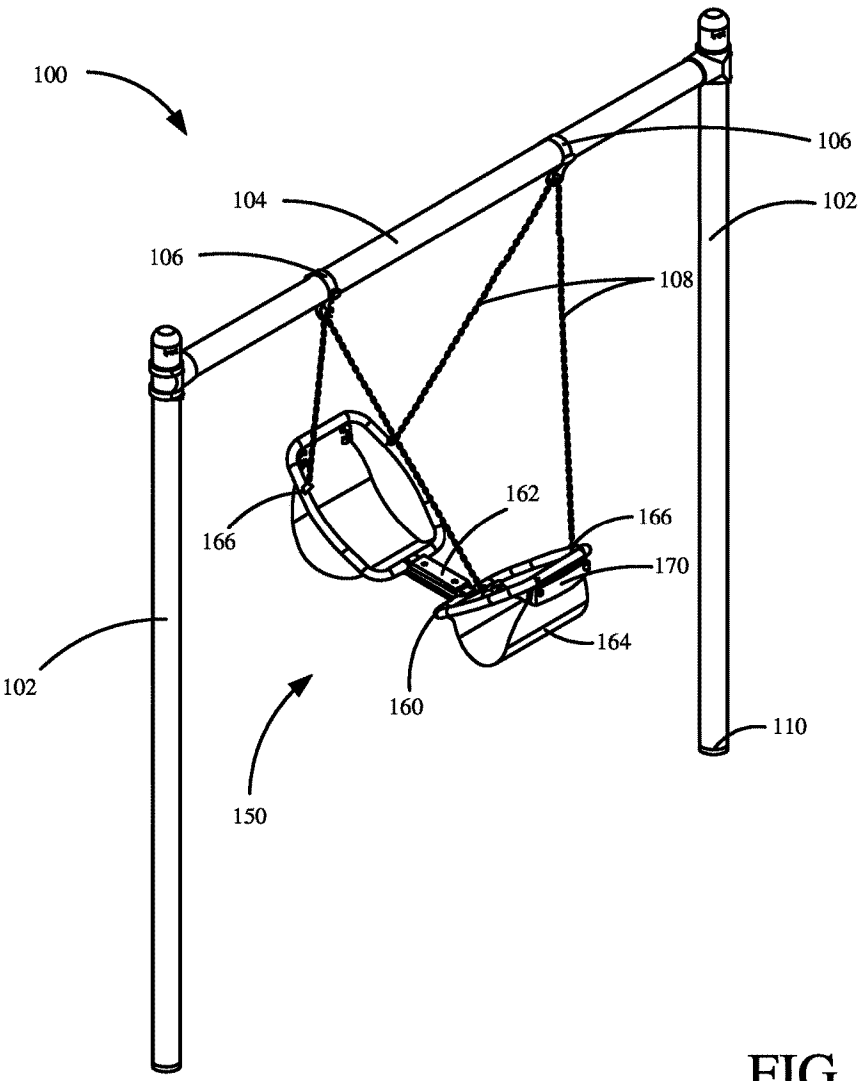
FIGS. 1A-1C illustrate views of a multi-user swing seat in a swing set in accordance with an embodiment of the present invention.
Figure 1B:
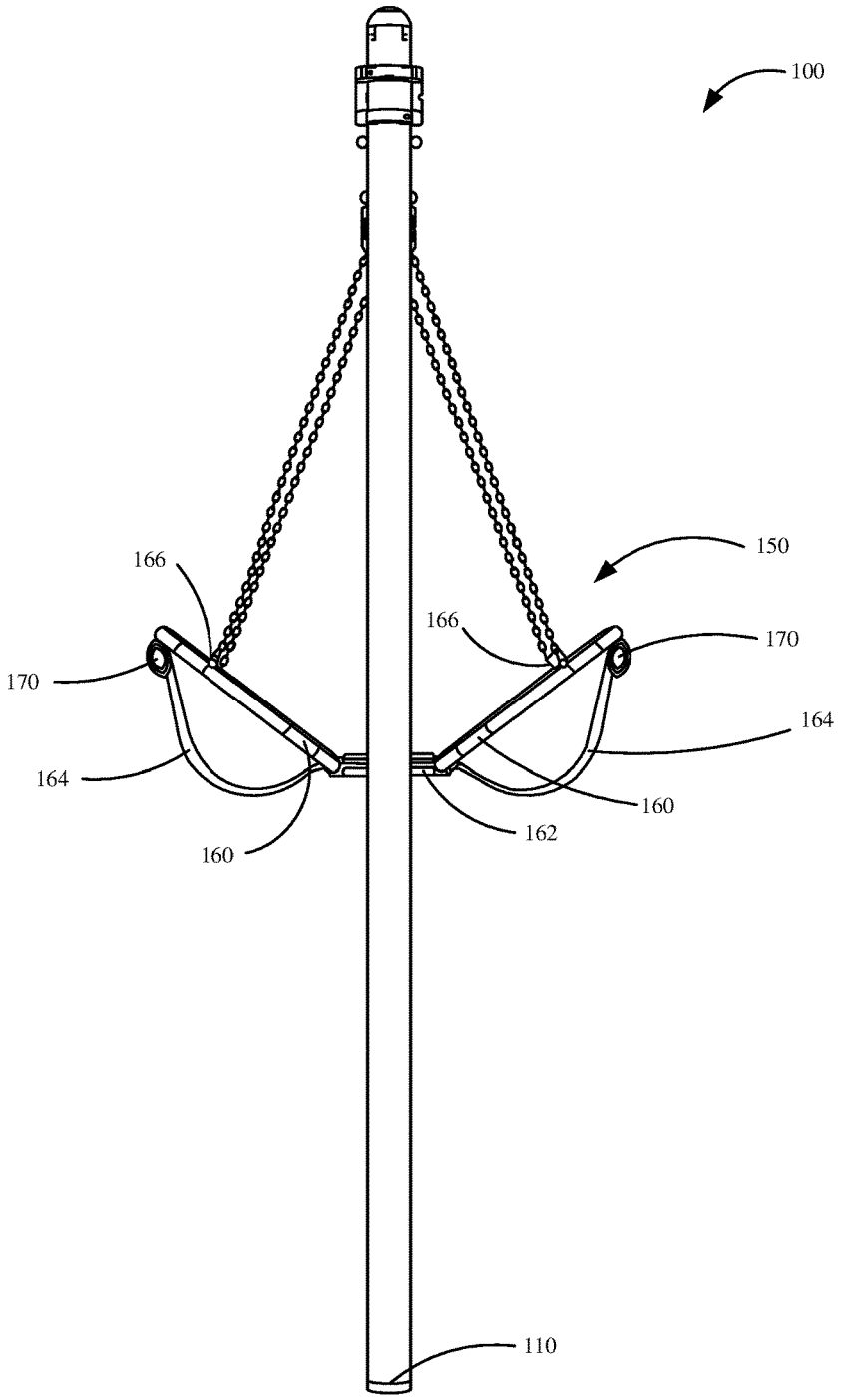
Figure 1C:
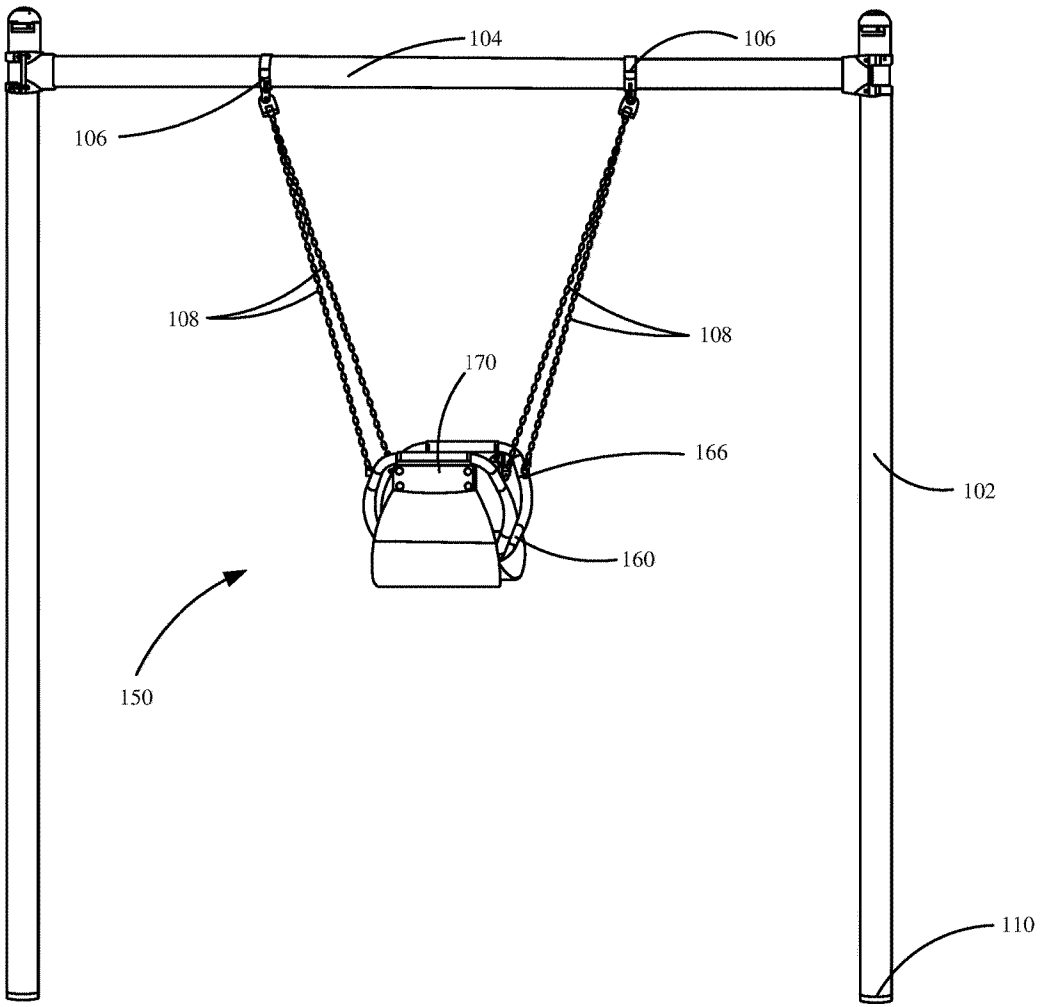

FIGS. 1A-1C illustrate views of a multi-user swing seat in a swing set in accordance with an embodiment of the present invention. FIG. 1A illustrates a perspective view of a swing set 100 with a multi-user swing seat 150. Swing set comprises a frame consisting of two or more supports 102 connected by a top bar 104. Swing seat 150 couples to the frame at one or more coupling points 106. While FIG. 1A illustrates a swing set 100 with two supports 102, other configurations are also envisioned, for example two supports 102 on either end of top bar 104, tilted at an angle with respect to each other. Additionally, while swing set 100 is illustrated with a single swing seat 150, in other embodiments multiple swing seats 150 may be present within a single swing set 100.

Swing seat 150 comprises a plurality of seating areas, each seating area defined by a frame 160 and a seat 164. In one embodiment, frame 160 also comprises a bumper 170. Seat 164, in one embodiment, comprises a rigid material, such as molded plastic or metal. In another embodiment, seat 164 comprises a flexible material, such as fabric or rubber. In the embodiment illustrated in FIG. 1A, seat 164 comprises a rubber belt material extending between a top and bottom edge of frame 160. In one embodiment, seat 164 comprises a weather-durable material configured to be exposed to, and withstand, weather related elements for a long period of time. While not illustrated in FIGS. 1A-1C, seat 164 may also comprise a safety device, such as a seat belt or harness configured to keep a user confined within 164.

The length of material used for 164 may be adjustable, for example a longer rubber belt may provide a deeper seat, while a shorter rubber belt may provide a shallower seat. In one embodiment, both of seats 164 on swing 150 comprise the same length of rubber belt, such that a symmetrical design is produced. In one embodiment, seat 164 couples along a perimeter of frame 160. In another embodiment, such as that illustrated in FIGS. 1A-1C, seat 164 couples only to a portion of the perimeter of frame 160, for example along a top edge and a bottom edge. In one embodiment, a width of seat 164 is approximately 9 inches. In one embodiment, a width of seat 164 is greater than 9 inches. In one embodiment, the side opening between the seat and the frame is sized to reduce a likelihood of a user falling out of the swing seat 150. In one embodiment, the side opening is sized to be less than approximately 3.5"×6.2".

Swing seat 150 may couple to each of coupling points 106 using a coupling mechanism 108. In some embodiments, coupling mechanism 108 comprises a rigid member, such as a pole. In other embodiments, coupling mechanism 108 comprises a flexible member, such as rope. In other embodiments, coupling mechanism 108 comprises a semi-rigid member, such as a chain. In one embodiment, coupling mechanism 108 comprises a chain with an outer coating, such as plastic. In another embodiment, cables are used. Cables may provide an advantage over a chain in that they are not prone to binding when twisted.

Coupling mechanism 108 attaches to seat 150 at one or more swing seat coupling points 166. In one embodiment, each frame 160 comprises two coupling points located between a top edge and a bottom edge. Coupling points 166 may be selected for stability of swing set 100. For example, if placed too close to the bottom edge of frame 160, swing seat 150 may be unstable and likely to tip over. However, if placed too close to the top edge of frame 160, swing seat 150 may swing from side to side unnecessarily. However, other coupling positions are also envisioned, for example only along the top edge. Placement at a lower position may allow for easier swinging, while higher placement allows for increased stability. In one embodiment, frame 160 is manufactured with coupling points 166 as a single piece. In another embodiment, coupling points 166 comprise separate elements, attached, for example, using a bolt, a weld, or another suitable coupling mechanism.

In one embodiment, frame 160 comprises metal. In one embodiment, frame 160 comprises heavy gauge steal. In another embodiment, frame 160 comprises lighter gauge steel. In one embodiment, a rigid frame 160 comprises a cover, for example a plastic, rubber, fabric or other suitable cover material. In another embodiment, the frame cover comprises padding to reduce a likelihood of injury.

FIG. 1B illustrates a side view of swing set 100. As illustrated in FIG. 1B, in one embodiment swing seat frames 160 are coupled by a coupling bridge 162, which extends linearly between a bottom edge of each frame 160. However, other coupling mechanisms are also envisioned. In one embodiment, coupling bridge 162 comprises a rigid material configured to prevent seat frames 160 from colliding during use, which could cause injury to one or both users. In one embodiment, coupling bridge 162 comprises a solid metal bar. In one embodiment, coupling bridge 162 also comprises a cover material. In another embodiment, coupling bridge couples between seats 164. In one embodiment, coupling bridge 162 has a length configured to allow for users of a variety of sizes. In one embodiment, coupling bridge 162 is adjustable.

At rest, bridge 162 may be parallel to a level ground. Also at rest, frames 160 may be at an angle relative to bridge 162. In one embodiment, the angle is about 37° from the horizon. In another embodiment, the angle is about 45° from the horizon. However, other angles may be possible, based on intended users. For example, a seat with a frame angle of 37° may be more comfortable for some users.

While FIGS. 1A-1C illustrate a connector extending between midpoints of bottom edges of frames 160, It is expressly contemplated that other connection points could also be used, for example along a side of frame 160, or at an outer edge of the bottom of frame 160.

As illustrated in FIG. 1B, each seat frame 160 also comprises a bumper 170. One hazard of swing sets in a playground environment is the risk of a swing user striking a bystander. Often, swing safety is measured by impact and acceleration on a potential person's head, which is indicated by head injury criteria (HIC). In one embodiment, bumper 170 makes swing 150 compliant with ASTM 1487-11, which requires a peak acceleration less than or equal to 100 g, and an HIC score of less than 500. In one embodiment, swing 150 is designed such that the average surface compression is less than 90 $N/cm^2$, with peak acceleration values less than 50 g. In one embodiment, bumper 170 achieves an HIC of mid-20s. In another embodiment, bumper 170 achieves an HIC of less than or equal to 100 g. In one embodiment, frame 160 comprises a lighter grade material, which reduces the weight of the swing assembly, which reduces acceleration and associated impact force. In one embodiment, bumper 170 replaces the bar of FIG. 6 in preventing fasteners from pulling through the seat material. In one embodiment, there may be greater or fewer bumpers 170. In one embodiment, frame 160 may be entirely covered by bumper-like materials.

FIG. 1C illustrates a substantially end-on perspective view of swing seat 150. As illustrated in FIG. 1C, in one embodiment, coupling points 106 are substantially further apart than a width of frame 160.

Figure 2:
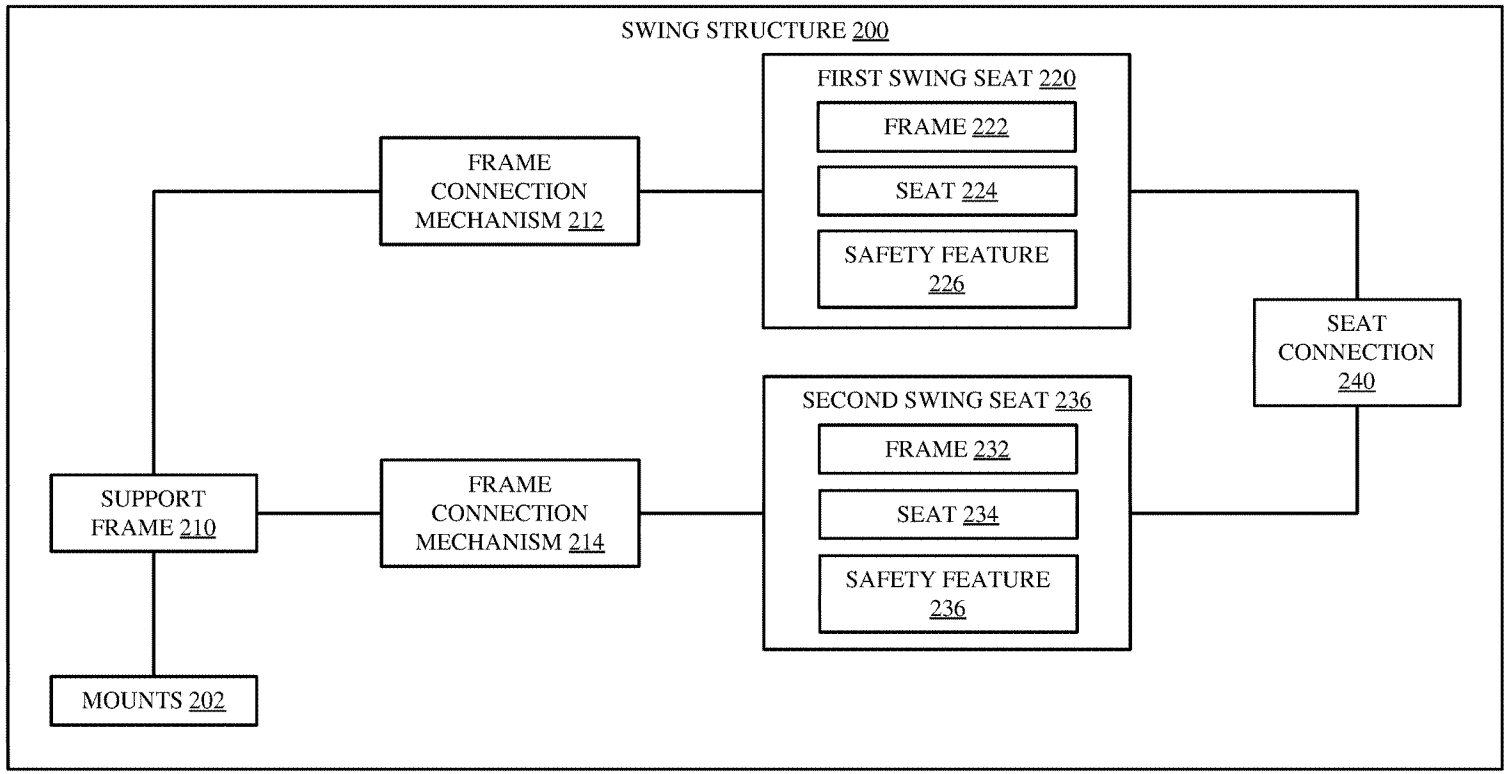
FIG. 2 illustrates a block diagram view of a swing set in accordance with an embodiment of the present invention.

FIG. 2 illustrates a block diagram view of a swing set in accordance with an embodiment of the present invention. Swing structure 200 may be designed for installation within a larger playground environment.

Swing structure 200 comprises one or more mounts 202 configured to maintain swing structure 200 in an upright position. In one embodiment, each portion of support frame 210 comprise a corresponding mounting location 202. For example, support frames may be bolted into an environment, or placed using direct bury methods. In one embodiment, swing structure 200 is permanently installed in a playground environment, and mounts 202 are substantially permanent.

Swing structure 200, in one embodiment, comprises a first swing seat 220 and a second swing seat 230. Swing seat 220 comprises a frame 222, a seat 224, and one or more safety features 226. Swing seat 230 also comprises a frame 232, a seat 234, and one or more safety features 236. In one embodiment, frames 222 and frame 232 are substantially identical, such that swing structure 200 has a symmetrical design. Safety features 226 and 236 may comprise, for example, seat belt or safety harnesses. Safety features 226 and 236 may also comprise bumpers.

Swing seats 230 and 220 are coupled together, in one embodiment, by seat connection 240. In one embodiment, seat connection 240 extends between frame 222 and 232. However, other placements are also envisioned. In one embodiment, seat connection 240 extends between bottom edges of frames 222 and 232. In another embodiment, seat connection 240 extends from a side of frame 222 to a side of frame 232.

In one embodiment, swing seat 220 couples to support frame 210 by a frame connection mechanism 212. Additionally, in one embodiment, swing seat 230 couples to support frame 210 by frame connection mechanism 214. However, there may be multiple frame connection mechanisms 212 for first swing seat 220, for example one on each side of frame 222.

Figure 3A:
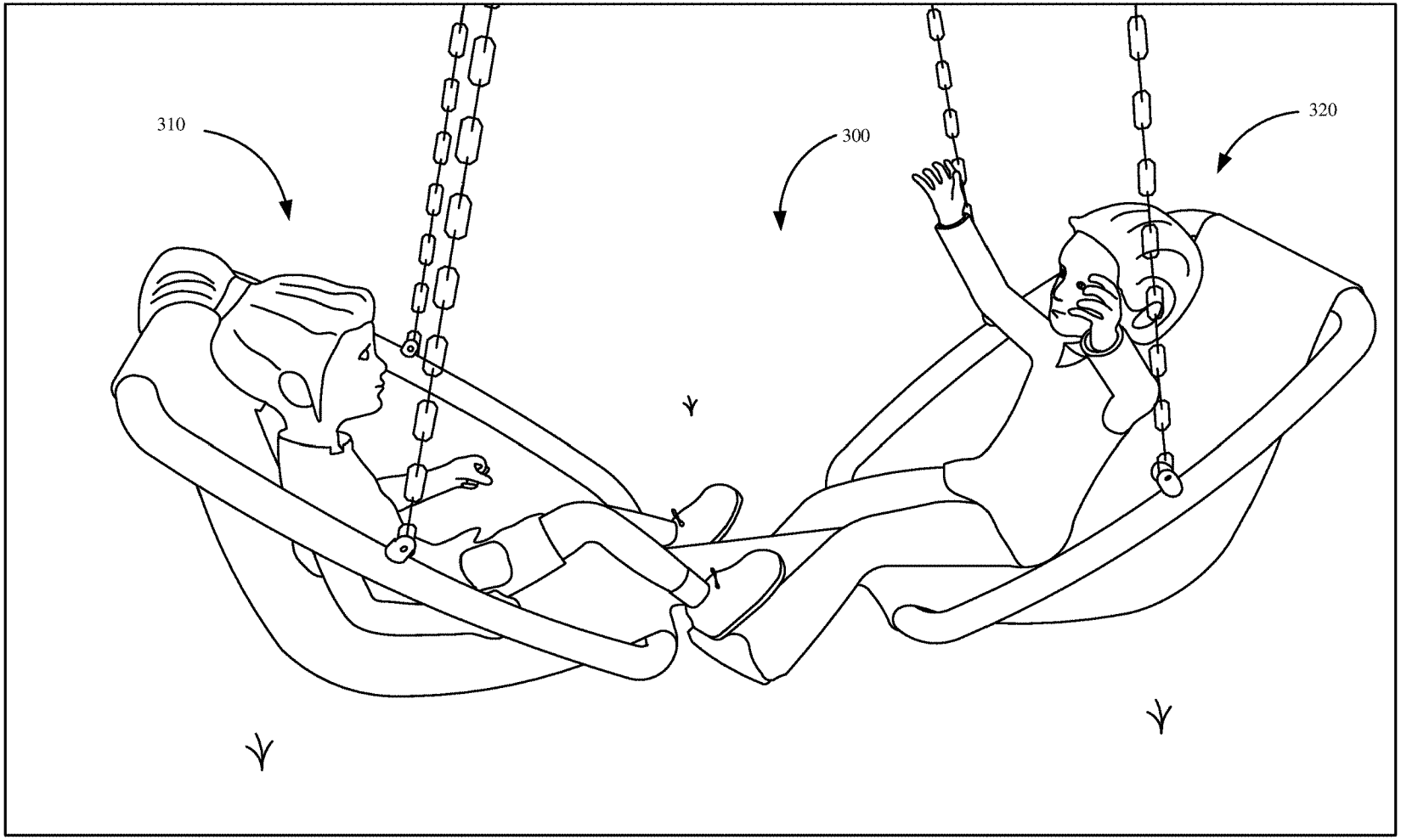
FIGS. 3A and 3B illustrate multi-user swing seats in accordance with embodiments of the present invention.
Figure 3B:
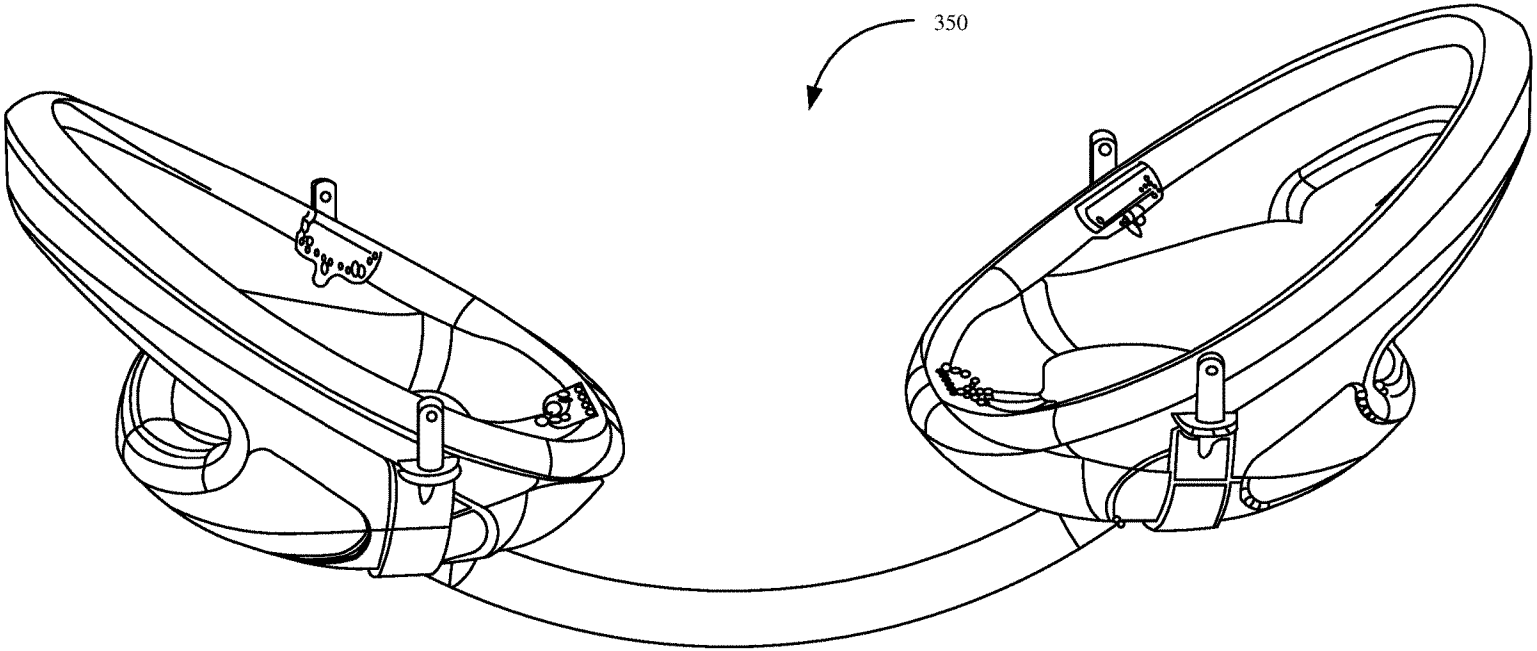

FIGS. 3A and 3B illustrate multi-user swing seats in accordance with embodiments of the present invention.

FIG. 3A illustrates two children using a multi-user swing seat 300. Swing seat 300, in one embodiment, is configured such that user 310 and user 320 are seated at substantially the same height, facing each other. However, other configurations are also possible, and in line with the symmetrical design of swing seat 300. For example, swing seat 300 could be configured such that users 310 and 320 are back-to-back or side-to-side. Additionally, while two children are illustrated, swing seat 300 is also configured to accommodate users of other sizes. For example, user 310 could be a parent facing a child 320. Alternatively, user 310 could be a parent with an infant facing a sibling 320. These, and other user configurations are also contemplated herein.

FIG. 3B illustrates another embodiment of a swing seat 350, in which two molded seats are coupled together by a single, arc-shaped connection piece.

Figure 4:
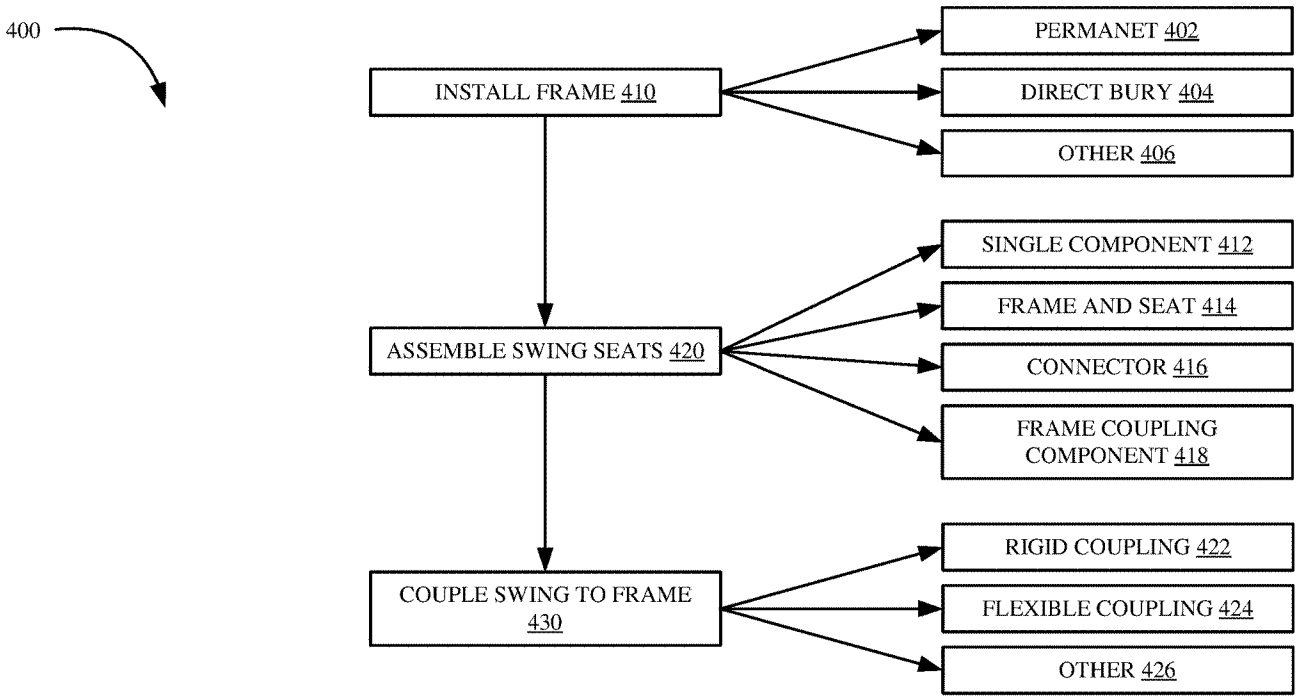
FIG. 4 illustrates a method of installing a multi-user swing seat in accordance with an embodiment of the present invention.

FIG. 4 illustrates a method of installing a multi-user swing seat in accordance with an embodiment of the present invention. Method 400 may be used to install a swing seat capable of seating multiple users simultaneously.

In block 410, a swing set frame is installed. In one embodiment, installing a swing set frame comprises permanently mounting frame supports within a play environment, as indicated in block 402. In one embodiment, permanent installation comprises a direct bury installation method, as indicated in block 404. However, other installation methods can also be used for a swing set frame, as indicated in block 406.

In block 420, a multi-user swing seat is assembled. As indicated in block 412, a swing seat may comprise a single component, for example molded plastic or metal. In another embodiment, assembling a multi-user swing seat comprises coupling a seat material to a frame, as indicated in block 414. In one embodiment, the multiple seating areas of the multi-user swing are each coupled to a connector 416. In some embodiments, the swing seats are assembled to include a frame coupling component, as indicated in block 418, to couple the seat to a swing set frame.

In block 430, the multi-user swing seat is coupled to the swing set frame. In one embodiment, the coupling is a rigid coupling, as indicated in block 422, for example by use of a plastic or metal pole. In another embodiment, the coupling is a flexible coupling, as indicated in block 424, such as a rope or a cable. In another embodiment, the coupling is a mixed coupling, for example a chain. Other suitable coupling mechanisms are also envisioned.

At least some embodiments described herein refer to a swing seat structure with only two seat assemblies. However, it is expressly contemplated that, in other embodiments, a greater number of seats can be assembled within a single multi-user swing seat. For example, three seats could be configured in a triangular shape, or for seats could be configured within a square or rectangular shape, etc. Other numbers of seats, and other configurations, are also expressly contemplated.

In some embodiments described herein, the multi-user swing seat is designed to be symmetrical, such that any seat can accommodate any type of user, e.g. no seat is limited to only seating an infant, child, or adult user. This may allow for increased use by a variety of users of different abilities, and in different configurations. For example, as discussed above, families with multiple children may be able to push two siblings on a single swing, as illustrated herein. Additionally, a parent may also be able to enjoy a swinging motion with one or more of their children.

Although the present invention has been described with reference to preferred embodiments, workers skilled in the art will recognize that changes may be made in form and detail without departing from the spirit and scope of the invention.

What is claimed is:

1. A swing set comprising:

a swing set frame;

a first swing comprising:

a first swing frame;

a first swing seat formed from a first belt that spans between two portions of the first swing frame;

a second swing comprising:

a second swing frame;

a second swing seat formed from a second belt that spans between two portions of the second swing frame;

a coupling bridge that couples the first swing to the second swing;

four swing coupling mechanisms, the first and second swing coupling mechanisms coupling the first swing to the swing set frame and the third and fourth swing coupling mechanisms coupling the second swing to the swing set frame; and wherein the first belt comprises a length such that a portion of the first belt hangs vertically lower than the coupling bridge, when the swing set is still.

2. The swing set of claim 1, wherein the first belt comprises a length such that the belt forms a backrest.

3. The swing set of claim 1, wherein the first belt wraps around one of the two portions of the first swing frame.

4. The swing set of claim 3, further comprising a bumper that is coupled to the first belt.

5. The swing set of claim 1, wherein the coupling bridge couples the first frame at an angle such that a first portion of the two portions of the first frame is lower than the second portion of two portions of the first frame.

6. The swing set of claim 5, wherein two of the four a swing coupling mechanisms couple to the first frame at a connection point disposed between the first potion and the second portion.

7. A swing for a playground:

a first frame comprising a first enclosed shape formed from tubular material;

a first belt coupled to the first frame at two points of the first enclosed shape;

a second frame comprising a second enclosed shape formed from tubular material;

a second belt coupled to the second frame at two points of the second enclosed shape; and a coupling bridge that couples that first frame to the second frame, wherein the first frame is coupled to the coupling bridge at a first angle with respect to the coupling bridge and the second frame is coupled to the coupling bridge at a second angle with respect to the coupling bridge.

8. The swing of claim 7, wherein the first enclosed shape and the second enclosed shape are rectangular.

9. The swing of claim 7, further comprising a first bumper and a second bumper, the first bumper coupled to the first frame and the second bumper coupled to the second frame.

* * * * *